US006600154B1

(12) United States Patent
Franzen et al.

(10) Patent No.: US 6,600,154 B1
(45) Date of Patent: Jul. 29, 2003

(54) ION FILLING CONTROL IN ION TRAP MASS SPECTROMETERS

(75) Inventors: Jochen Franzen, Bremen (DE); Andreas Brekenfeld, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 202 days.

(21) Appl. No.: 09/873,107

(22) Filed: Jun. 1, 2001

(30) Foreign Application Priority Data

Jun. 2, 2000 (DE) ..... 100 27 545

(51) Int. Cl.[7] ..... H01J 49/42
(52) U.S. Cl. ..... 250/282; 250/291; 250/292
(58) Field of Search ..... 250/282, 290, 250/291, 292

(56) References Cited

U.S. PATENT DOCUMENTS 5,300,772 A * 4/1994 Buttrill, Jr. ..... 250/282
5,479,012 A * 12/1995 Wells ..... 250/282

FOREIGN PATENT DOCUMENTS

| | | |
|---|---|---|
| DE | 43 26 549 C1 | 8/1994 |
| EP | 0 113 207 A2 | 7/1984 |
| EP | 0 237 268 A2 | 9/1987 |
| GB | 2 280 781 A | 8/1995 |

OTHER PUBLICATIONS

Todd, J.F.T. et al., "Quadrupole Ion Traps", Quadrupole Mass Spectrometry and Its Applications, 1976, 181–224, Elsevier Scientific Publishing Company, Amsterdam, Netherlands.

Cox, K.A. et al., "Mass Shifts and Local Space Charge Effects Observed in the Quadrupole Ion Trap at Higher Resolution", International Journal of Mass Spectrometry and Ion Processes 144 (1995) 47–65, Elsevier Scientific B.V., Amsterdam, Netherlands.

Vedel, Fernande, On the "Dynamics and Energy of Ion Clouds Stored in an R.F. Quadrupole Trap", International Journal of Mass Spectrometry and Ion Processes,106 (1991) 33–61, Elsevier Scientific B.V., Amsterdam, Netherlands.

* cited by examiner

*Primary Examiner*—Jack Berman

(57) ABSTRACT

The invention relates to the control of the filling process of an ion trap with ions in order to avoid the deteriorating effect of too many stored ions on the quality of the spectrum during a mass scan. In the prior art, the "number of ions" inside the ion trap were used to contol filling. However, controlling the number of ions does not provide optimum trap filling for different ion compositions. The invention overcomes the problem by controlling a mass-dependent physical parameter and applying an cluster-dependent target value. This method takes into account the mass-dependency of optimum ion filling as well as the effect of non-uniform distribution of ions of different mass-to-charge ratios over the mass spectrum.

12 Claims, No Drawings

ION FILLING CONTROL IN ION TRAP MASS SPECTROMETERS

BACKGROUND OF THE INVENTION

From dozens of publications, it has been know that the ion traps of both ion cyclotron resonance and quadrupole high frequency ion-trap mass spectrometers should not be filled with ions beyond a certain limiting value, as otherwise the ion cloud will have a noticeable effect on the oscillation behavior of the ions being detected or ejected and detection via resonance absorption or resonance ejection will therefore cease to yield the correct mass determination.

A method of control is described in Patents U.S. Pat. No. 4,548,884 (EP 0 113 207 B1) for the general case and U.S. Pat. No. 5,107,109 (EP 0 237 268 B1) for the specific case. Both cases aim to overcome problems with the feeding of substances from gas chromatography. The patents apply to quadrupole high frequency ion-trap mass spectrometers with non-resonant ion ejection at the stability limit of the Mathieu diagram. In both cases, the "number of ions" is controlled in the trap.

Up to now, always the "number of ions" in the ion trap has been controlled. This is the case also for the resonant ejection of ions during the mass scan. The number of ions is being easily obtained from a preliminary measurement, a "prescan" (according to U.S. Pat. No. 5,107,109 or EP 0 237 268 B1) or, if spectra could be acquired rapidly enough, by integrating the ion current of one or more previous spectra, as described in U.S. Pat. No. 5,559,325 (GB 2 280 781 or DE 43 26 549).

In both cases, the "number of ions", or better: the total charge, is measured in the trap and used for control purposes. This "number of ions" is determined as the integral of the ion current via a previously recorded spectrum or is determined by a preliminary experiment where the ion trap is briefly filled and then rapidly emptied while carrying out an integral measurement of the ejected ions. For this control, it is assumed that the measurement of the ion current via secondary electron multipliers is accurate enough; the dependence of the measurement on the structure and charge of the ions is neglected with complete justification since, in principle, the measurement itself is sufficient for the accuracy of the control.

However, controlling the number of ions in the ion trap has always failed to yield the optimum results. In particular, the sensitivity of the ion trap is considerably diminished due to a sufficiently large safety tolerance which has to be maintained. In many cases, the maximum number of ions which can be tolerated is by far not reached, that is, the number of ions which can be stored without worsening the quality of the spectrum. For safety reasons, it is often necessary to remain below the optimum value by a factor of three to five, thereby sacrificing valuable sensitivity.

It is very easy to observe that a spectrum which contains only a single ion species (a group of isotopes) in the lower mass range at, for example, 300 atomic mass units, tolerates a significantly larger number of ions than a spectrum with only one ion species in the upper mass range at, for example, 3000 mass units. For this reason, the usual method which has been adopted until now of simply controlling the number of ions at a fixed target value cannot be used to minimize the effects of ion filling on the quality of the spectrum while maintaining the highest level of sensitivity. In the case of heavy ions, the number of ions is too large and in the case of light ions, the number of ions is too small.

Apart from this, it can be observed that a spectrum containing only a single species of ions (of essentially one mass) tolerates significantly fewer ions than a spectrum containing many different species of ions of similar intensity but with different masses which are, to some extent, distributed reasonably evenly over the mass range of the spectrum. The distribution depends on the substance or mixture of substances which has been introduced and cannot be predicted.

These two observations, which are easily obtained, confirm that the previously used method of controlling the number of ions in the ion trap will not lead to the optimum utilization of the sensitivity of an ion trap mass spectrometer.

SUMMARY OF THE INVENTION

In accordance with the invention, a new control parameter is applied that avoids the effect of the ion load on the spectrum quality better than just the number of ions, especially for resonance ejection of ions from the ion trap. A spectrum of optimum signal strength is measured while maintaining the highest sensitivity, even if the composition of ions with respect to their mass-to-charge ratio is varied. To produce an undistorted spectrum at the optimum signal strength, control is not determined by the "number of ions" but by a new physical parameter composed of both the charge and the mass of the ions. This parameter is called the "charge inertia" $\mu$ and is proportional to the charge q and the square root of the mass-to-charge ratio of the ion $\sqrt{m/q}$. Thus the charge inertia becomes $\mu=q\sqrt{m/q}=\sqrt{q/m}$. Both the actual and the target filling values in the ion trap are defined as the sum of the charge inertias of all ions in the trap. This charge inertia has a different physical dimension and a different measuring unit: while the charge has the unit A×s (Ampere second), the charge inertia has the unit $(A\times s\times kg)^{1/2}$.

The invention consists of controlling the filling of the ion trap for a sequence of spectrum acquisitions so that the filling status, which is defined as the sum of charge inertias $\mu$ of all ions in the ion trap, assumes a predetermined target value for the charge inertia as near as possible each time the trap is filled. At the same time, the target value is chosen to be slightly below the threshold above which the effect of the ions in the ion trap on the spectrum can be seen and measured by a slight displacement (slightly delayed ejection) and slight broadening (slightly smeared ejection) of the mass lines. Control can be achieved by automatically comparing the actual measured value of the filling status in prior spectra with the target value and then choose a correspondingly longer or shorter filling time for the next spectrum.

The actual value of the filling status for a previously recorded spectrum can be obtained, for example, by weighted summation of the measured ion current values using the square root of the mass-to-charge ratio as the weighting factor. The prevailing ion current can be multiplied by the square root of the mass-to-charge ratio on both a digital and an analog basis, for example, in an analog way by increasing the amplification of the ion current signal amplifier proportional to the square root of the mass-to-charge ratio while the spectrum is being recorded and feeding the amplifier output to an integrator. The summation for determining the measured actual filling status can be obtained in real time while the spectrum is being recorded so that the actual value is immediately available after the spectrum has been scanned. The filling rate for the next spectrum can then be calculated from the actual filling status, that is from the charge inertia calculated by the spectrum and the known filling time. This filling rate is then used for controlling ion filling for the next spectrum.

The trend of a filling rate which may rapidly change from one spectrum to the next (due to the rapidly changing concentration of substances fed to the mass spectrometer from, for example, a chromatograph) can be calculated by calculating the trend of filling rates from several previously recorded spectra, as shown by the description of the trend calculation in U.S. Pat. No. 5,559,325 (GB 2 280 781, DE 43 26 549). The trend calculation produces a prospective filling rate which is then used for control.

It now appears that the optimum filling of an ion trap for producing a high quality mass spectrum is determined by the distribution of the ions over the individual sections of the spectrum. If the ions are concentrated within a small mass-to-charge range, filling must be maintained at a much lower status than if the ions are distributed uniformly over the entire spectrum.

Another basic idea in this invention therefore takes into account the effect of ion clustering within narrow ranges of specific masses (that is mass-to-charge ranges) during control by adapting the target value for the filling status. Also in this case information about ion clustering is obtained from previously recorded spectra.

In order to achieve this, the maximum charge inertia which appears within a small specific mass range (for example, within a m/z range of 5, 10, 20 or 50 atomic mass units divided by the number z of elementary charges) is compared with the total charge inertia for the entire spectrum. If the quotient of the total charge inertia and the maximum charge inertia in the range is almost equal to unity, then all the ions in the spectrum are clustered within this small mass range and the target value for control will have to be given a correspondingly low value. However, if the maximum charge inertia of the individual mass ranges is small in comparison to the total charge inertia, then the target value for the control can be higher. A good proportionality factor to use for the target value is, for example, the square root of the quotient of the total charge inertia and the maximum charge inertia found within the mass ranges. However, other relationships can also be used. Fixed mass-to-charge ranges can be used to establish the maximum for the charge inertia, but these can also be shifted over the entire spectrum in a similar way to a "running" average.

DETAILED DESCRIPTION

The invention herein relies on certain observed phenomena. Inside an ion trap there is a so-called pseudopotential which drives all captured ions towards the center and, in an ion trap without damping, allows them to oscillate around the center with whatever initial kinetic energy they may have had. However, an ion trap is operated with an damping gas which absorbs the kinetic energy of the oscillating ions, thus causing the ion cloud to collect in the center of the trap. The distance of the ions from each other in the ion cloud at the center is determined by the equilibrium between the pseudopotential field which drives the ions to the center and the Coulomb's repulsion force between the ions which keeps them apart.

The frequency of axial oscillation of the ions (in the so-called z direction of the ion trap, i.e. the axis of rotational symmetry) is determined by the high-frequency field and the mass-to-charge ratio of the ions. In this case, the mass-to-charge ratio is called the "specific mass" (following the inventor of the ion trap, Wolfgang Paul). The mass-dependent oscillation of an ion can be excited by an alternating voltage between the end caps of the ion trap. This axial oscillation which is amplified by the excitation in cases of resonance causes the ion to pass periodically through the cloud of other ions.

It is easy to appreciate that an ion of high specific mass can relatively easily oscillate through a cloud consisting entirely of ions of low specific mass. The lighter ions can move out of the way relatively easily. On the other hand, an ion of low specific mass which has been excited in the z direction can, in the limiting case, merely bounce off the outer boundary of a cloud of entirely heavy ions. It is much more difficult for the light ion to oscillate through a cloud of heavy ions. In fact it is only possible at all because the ions of high specific mass in the cloud in the pseudopotential field experience a weaker force towards the center and therefore form a larger and less dense cloud with larger inter-ionic distances. Indeed, it is common understanding among scientists that in a cloud of mixed ions, the ions of high specific mass are located on the outside.

A cloud which is made up of ions of high specific mass is "stiffer" than a cloud made up of ions of low specific mass. Because of their higher specific mass, the individual particles do not yield so easily. This should be made clear by the term "charge inertia" introduced above (the mass-related inertia of the charges which oppose the movement of a particle).

Furthermore, while the spectrum is being recorded, the ions of low specific mass are ejected first so the ion trap becomes more and more empty for the heavier ion measurement when there is a mixture of heavy and light ions. These factors explain why the optimum ion filling which does not impede ejection of the ions, and therefore does not impair the quality of the spectrum, is not simply determined by the number of ions, as previously assumed, but by the distribution of ions of different specific masses over the whole spectrum.

If the cloud contains only two ionic types with almost the same mass, say m/e and (m+1)/e, then their oscillation frequencies will be almost the same. In a well damped cloud without external excitation, the ions hardly ever change position in the almost crystalline cloud. However, if the ionic types of one m/e is excited by resonance, then the cloud as a whole starts to oscillate and ions of only slightly higher specific mass are induced to oscillate synchronously due to a sort of friction coupling: the ions experience "coupled" oscillation. The coupling is the stronger the more there are of the ions of both types in the ion trap.

If these two ionic types are to be measured separately, that is ejected separately, then coupling must be suppressed as much as possible. This can only be achieved by filling the ion trap with fewer ions.

If, however, the two ions are in a cloud containing many ions of other specific masses, then the cloud is "agitated" continuously by exciting all these ionic types sequentially and coupling is practically prevented.

One embodiment of the method which is particularly preferred is described as follows:

The charge inertia is determined and totaled in each case in real time during a continuous series of spectral scans. For this purpose, each measured value of the ion current, which is sampled and digitized at approximately four-microsecond intervals, is multiplied by a value for the square root of the mass-to-charge ratio taken from a table and totaled. Using modern processors which operate at clock times of nearly a gigahertz, this can be achieved without any difficulty. Thus, only a few microseconds after the scan has ended, a value for the charge inertia, and therefore the measured filling status, is available for controlling the filling of the ion trap for the next spectrum.

If approximately 12 measurements are carried out for each atomic mass unit per charge scanned, a spectrum ranging from 300 u/z to 3000 u/z (z=number of elementary charges, i.e. the charge of an electron or proton) will be recorded in approximately 130 milliseconds. Approximately 3200 measurements are carried out, digitized and stored.

Using modern processors with clock times of many hundreds of megahertz, the product of the ion current and the square root of the mass-to-charge ratio can be calculated and totaled within the approximately four microseconds which are available between measurements.

The maximum partial charge inertia is determined at the same time. A sum of partial charge inertias is also calculated in parallel with the scanning rate over a narrow mass range of approx. 10 atomic mass units per elementary charge, that is more than 120 measurements. The maximum of the running total is retained. The running total is calculated in the usual way by adding the new value from the freshly measured charge inertia and subtracting the value of the charge inertia at the end of the narrow measurement range.

After the spectrum has been recorded, the quotient is calculated from the total charge inertia and the maximum partial charge inertia, the square root of the value is found and the result multiplied by a base target value. This value represents the newly determined target value for the filling status and takes into account the distribution of ion species over the entire spectrum. The base target value has been determined for optimum filling using only a single ion species.

Control consists of calculating the filling rate from the calculated filling status (the measured actual filling value) and the known filling duration. To record the next spectrum, a filling period is now calculated from the target value for filling and the filling rate. This filling period is used for filling.

Even better control is obtained by not only using the filling rate of the latest spectrum alone, but also by deriving a trend from the filling rates from the previous two, three or even more spectra and using this to determine—in advance—a prospective filling rate. The trend analysis can be obtained from simple linear, square or cubic extrapolation of the filling rates, but also from other knowledge about the chromatographic peaks and their shape, as described in detail in U.S. Pat. No. 5,559,325 (equivalent to GB 2 280 781 or DE 43 26 549). This trend analysis has particular advantages where substance concentrations change suddenly, which is characteristic for chromatography. Substance concentrations are inversely proportional to the filling rates.

In the method described above, it is assumed that the distribution of ions over the whole spectrum does not change drastically from spectrum to spectrum. Only the last spectrum therefore needs to be used for calculating the target filling value. In general, this is also true for chromatographic separations involving the measurement of 10 spectra for a single substance peak. However, if need be, the target filling value for the charge inertia can also be calculated from a trend analysis of the cluster quotients or the correction factors for the target values of several previous spectra. The method according to the invention compensates for the drastic change in substance concentration over the chromatographic peak. At the same time, different numbers of ions can be stored from peak to peak, depending on the number of light or heavy ions, and different target values can appear from peak to peak because different substances can each generate a different ion cluster.

This method produces much better results than the method which was in common use before, in which the number of ions was controlled to a fixed target value for the chromatographic run. The method according to this invention therefore makes much better use of the ion trap and the number of ions is generally much higher since only a very.small safety distance for the target value from the interference limit of the space charge has to be maintained. Special features of the spectrum such as the ion clusters found within small mass ranges which are produced by the previously unknown structure of the ions are taken into account.

The safety distance needs only to be approx. 20% in order to compensate for the dependence of the multiplier sensitivity on the structure of ions which are otherwise of the same mass, and other weak unforeseeable effects. According to the prior art, the setpoint value was put at one third of the interference limit; this alone increases the sensitivity by more than a factor of two.

Calculating the square root of the mass-to-charge ratio is inconvenient; storage in a table is lavish. Thus, the value for the square root of the mass-to-charge ratio can also be easily replaced by a piecewise linear dependency on the mass. Normally, only a mass range with a mass ratio of 1:10 is used, such as the range from 300 to 3000 atomic mass units. For this range, for example, the value $(m+m_o)$, in which $m_o=1000$, (as a proportional approximation for the value of the square root of the mass-to-charge ratio m/z) can also be used as a factor which in this wide range is largely proportional to the square root, with a maximum deviation from proportionality of only 16%. This 16% can easily be taken into account when establishing the safety distance.

From these basic ideas, the mass spectrometry specialist will easily be able to derive other methods if direct implementation of the methods described here does not provide the optimum solution for his analytical task.

What is claimed is:

1. Method for controlling the filling of an ion trap of a high-frequency quadrupole ion trap mass spectrometer with ions, the method comprising:

determining, for at least one previous filling of the ion trap, a value indicative of a sum of the charge inertias of the ions previously stored in the ion trap, where charge inertia for a given ion is defined as the product of its ion charge and the square root of its specific mass; and filling the ion trap so as to closely approximate a predetermined target value of total charge inertia in the ion trap based on the previously determined value of summed charge inertias.

2. Method according to claim 1 wherein the filling is based on a comparison between an actual value of total charge inertia from at least one previous filling of the ion trap and the predetermined target value for the charge inertia, and wherein said actual value is determined using ion-current measurements obtained while a mass spectrum is being recorded.

3. Method according to claim 2 wherein the actual value for charge inertia is calculated by summing the results of multiplying the ion-current values by the square root of the specific masses or corresponding approximated values.

4. Method according to claim 2 wherein the actual value for the charge inertia is calculated by summing the values of the amplified ion-current signals, where the amplification factor during the spectrum scan has been increased exactly or approximately proportionally to the square root of the specific mass of the ions.

5. Method according to claim 2 wherein an actual value for a filling rate is determined from the actual value for the charge inertia and the associated time period for the filling process.

6. Method according to claim 5 wherein control of the filling process consists of determining the time period for filling from the actual value for the filling rate and the target value for the charge inertia and using this time period for the next filling process.

7. Method according to claims 4 wherein the actual values of the associated filling charge inertias and filling rates are calculated while recording a series of spectra, a prospective value for the filling rate for the next spectrum is calculated from one or more previously recorded spectra, and this prospective value for the filling rate is used for controlling the filling process for the next spectrum.

8. Method according to claim 7 wherein the prospective value for the filling rate for controlling the filling of the ion trap is obtained from a trend analysis of the measured actual values of several previous filling rates.

9. Method according to claim 2 wherein the target value for the charge inertia is made to depend on the distribution of the specific masses of the ions over the spectrum.

10. Method according to claim 9 wherein the target value depends on a quotient obtained from the total charge inertia for the spectrum and a maximum of partial charge inertias from partial specific mass ranges of the spectrum.

11. Method according to claim 10 wherein the partial specific mass ranges are 5, 10, 20 or 50 mass units per elementary charges in size.

12. Method according to claim 10 wherein the target value is higher by a proportionality factor than the basic target value, and the square root of the quotient of the total charge inertia for the spectrum and the maximum of the partial charge inertias is used as the proportionality factor.

* * * * *